US008721026B2

(12) United States Patent
Shin et al.

(10) Patent No.: US 8,721,026 B2
(45) Date of Patent: May 13, 2014

(54) METHOD FOR IDENTIFYING AND VERIFYING DASH STRUCTURES AS CANDIDATES FOR TEST PATTERNS AND REPLACEMENT PATTERNS IN AN INKJET PRINTER

(75) Inventors: Helen HaeKyung Shin, Fairport, NY (US); Howard A. Mizes, Pittsford, NY (US); Jeffrey J. Folkins, Rochester, NY (US); David A. Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 494 days.

(21) Appl. No.: 12/781,558

(22) Filed: May 17, 2010

(65) Prior Publication Data

US 2011/0279505 A1 Nov. 17, 2011

(51) Int. Cl.
*B41J 29/393* (2006.01)

(52) U.S. Cl.
USPC ..... 347/19; 347/14; 347/16

(58) Field of Classification Search
None
See application file for complete search history.

(56) References Cited

U.S. PATENT DOCUMENTS 4,328,504 A 5/1982 Weber et al.
4,509,057 A 4/1985 Sohl et al.
5,075,689 A 12/1991 Hoisington et al.
5,160,938 A 11/1992 Fargo et al.
5,212,497 A 5/1993 Stanley et al.
5,343,231 A 8/1994 Suzuki
5,451,990 A * 9/1995 Sorenson et al. ..... 347/37
5,477,244 A 12/1995 Shibata et al.
5,576,744 A 11/1996 Niikura et al.
5,600,350 A 2/1997 Cobbs et al.
5,726,690 A 3/1998 Bohorquez et al.
5,796,414 A 8/1998 Sievert et al.
5,831,658 A 11/1998 Iga et al.
5,835,108 A 11/1998 Beauchamp et al.
5,847,724 A 12/1998 Mantell
5,903,681 A 5/1999 Rueby et al.
5,923,344 A 7/1999 Norum et al.
5,992,962 A 11/1999 Yen et al.
6,076,915 A 6/2000 Gast et al.
6,089,693 A 7/2000 Drake et al.
6,102,513 A 8/2000 Wen
6,141,114 A 10/2000 Mantell et al.
6,145,959 A 11/2000 Lund et al.
6,168,261 B1 1/2001 Miyake et al.
6,196,652 B1 3/2001 Subirada et al.
6,206,502 B1 3/2001 Kato et al.
6,247,787 B1 6/2001 Giere et al.
6,273,542 B1 8/2001 Couwenhoven et al.
6,275,600 B1 8/2001 Banker et al.

(Continued)

*Primary Examiner* — Uyen Chau N Le
*Assistant Examiner* — Chad Smith
(74) *Attorney, Agent, or Firm* — Maginot Moore & Beck, LLP

(57) ABSTRACT

A method compensates for changes in drop velocity of drops emitted by inkjets in a printhead of an ink jet imaging device. The method includes operating inkjet ejectors in a plurality of printheads to eject ink in a pattern of structured dashes on an image receiving member, the structured dashes corresponding to a predetermined image data pattern, generating image data corresponding to the pattern of structured dashes on the image receiving member, identifying a process direction correction parameter for each ejector in the plurality of printheads with reference to the generated image data, modifying image data to be printed by the plurality of printheads with reference to the process direction correction parameter identified for at least one of the ejectors, and operating the plurality of printheads with reference to the modified image data.

3 Claims, 8 Drawing Sheets

(56) References Cited

U.S. PATENT DOCUMENTS

| | | | |
|---|---|---|---|
| 6,300,968 | B1 | 10/2001 | Kerxhalli et al. |
| 6,315,383 | B1 | 11/2001 | Sarmast et al. |
| 6,334,720 | B1 | 1/2002 | Kato et al. |
| 6,367,903 | B1 | 4/2002 | Gast et al. |
| 6,377,758 | B1 | 4/2002 | OuYang et al. |
| 6,390,580 | B1 | 5/2002 | Anderson et al. |
| 6,464,334 | B2 | 10/2002 | Lopez et al. |
| 6,467,867 | B1 | 10/2002 | Worthington et al. |
| 6,494,558 | B1 | 12/2002 | Doval et al. |
| 6,532,026 | B2 | 3/2003 | Takahashi et al. |
| 6,554,390 | B2 | 4/2003 | Arquilevich et al. |
| 6,568,786 | B2 | 5/2003 | Sarmast et al. |
| 6,590,598 | B2 | 7/2003 | Kodama |
| 6,637,853 | B1 | 10/2003 | Ahne et al. |
| 6,764,156 | B2 | 7/2004 | Mantell |
| 6,814,425 | B2 | 11/2004 | Mott et al. |
| 6,819,352 | B2 | 11/2004 | Mizes et al. |
| 6,847,465 | B1 | 1/2005 | Wetchler et al. |
| 6,883,892 | B2 | 4/2005 | Sievert et al. |
| 6,942,313 | B2 | 9/2005 | Kanda |
| 6,993,275 | B2 | 1/2006 | Mitsuya et al. |
| 7,073,883 | B2 | 7/2006 | Billow |
| 7,090,324 | B2 | 8/2006 | Mizes |
| 7,118,188 | B2 | 10/2006 | Vilanova et al. |
| 7,201,462 | B2 * | 4/2007 | Shibata et al. ..... 347/19 |
| 7,254,254 | B2 | 8/2007 | Ueda et al. |
| 7,314,261 | B2 | 1/2008 | Jackson Pulver et al. |
| 7,347,525 | B2 | 3/2008 | Mizes |
| 7,367,642 | B2 | 5/2008 | Ouchi et al. |
| 7,380,897 | B2 | 6/2008 | Anderson et al. |
| 7,390,073 | B2 | 6/2008 | Bailey et al. |
| 7,391,525 | B2 | 6/2008 | Chapman et al. |
| 7,478,894 | B2 | 1/2009 | Kim et al. |
| 7,515,305 | B2 | 4/2009 | Mizes |
| 7,524,007 | B2 | 4/2009 | Pulver et al. |
| 7,524,015 | B2 | 4/2009 | Srinivasan et al. |
| 7,543,911 | B2 | 6/2009 | Mizes et al. |
| 7,549,721 | B2 | 6/2009 | Nakano et al. |
| 7,552,986 | B2 | 6/2009 | Mizes et al. |
| 7,597,418 | B2 | 10/2009 | Mantell et al. |
| 7,607,752 | B2 | 10/2009 | Childers et al. |
| 7,630,653 | B2 | 12/2009 | Bonino |
| 7,637,586 | B2 | 12/2009 | Yun |
| 7,686,298 | B2 | 3/2010 | Fioravanti et al. |
| 2002/0135629 | A1 | 9/2002 | Sarmast et al. |
| 2003/0231350 | A1 | 12/2003 | Yamagishi |
| 2004/0160468 | A1 | 8/2004 | Kim et al. |
| 2005/0099447 | A1 | 5/2005 | Hsu et al. |
| 2009/0003729 | A1 | 1/2009 | Metcalfe et al. |
| 2009/0322849 | A1 | 12/2009 | Calamita et al. |
| 2010/0013882 | A1 | 1/2010 | Mizes et al. |

* cited by examiner

METHOD FOR IDENTIFYING AND VERIFYING DASH STRUCTURES AS CANDIDATES FOR TEST PATTERNS AND REPLACEMENT PATTERNS IN AN INKJET PRINTER

TECHNICAL FIELD

This disclosure relates generally to ink drop position correction for an imaging device having one or more printheads, and, more particularly, to identification of image data patterns useful for test patterns and replacement patterns in an inkjet printer.

BACKGROUND

Ink jet printers have print heads that operate a plurality of ejection jets from which liquid ink is expelled. The ink may be stored in reservoirs located within cartridges installed in the printer, or the ink may be provided in a solid form and then melted to generate liquid ink for printing. In these solid ink printers, the solid ink may be in either pellets, ink sticks, granules or any other shape. The solid ink pellets or ink sticks are typically placed in an "ink loader" that is adjacent to a feed chute or channel. A feed mechanism moves the solid ink sticks from the ink loader into the feed channel and then urges the ink sticks through the feed channel to a heater assembly where the ink is melted. In some solid ink printers, gravity pulls solid ink sticks through the feed channel to the heater assembly. Typically, a heater plate ("melt plate") in the heater assembly melts the solid ink impinging on it into a liquid that is delivered to a print head for jetting onto a recording medium.

A typical inkjet printer uses one or more printheads. Each printhead typically contains an array of individual nozzles for ejecting drops of ink across an open gap to an image receiving member to form an image. The image receiving member may be a continuous web of recording media or it may be a rotating intermediate imaging member, such as a print drum or belt. In the print head, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a print head controller in accordance with image data. An inkjet printer forms a printed image in accordance with the image data by printing a pattern of individual ink drops at particular locations on the image receiving member. The locations where the ink drops landed are sometimes called "ink drop locations," or "ink drop positions." Thus, a printing operation can be viewed as the placement of ink drops on an image receiving member in accordance with image data.

Ejections of ink drops from different inkjet ejectors in the same printhead are not always uniform. Slight variations in the drop ejection angles of the inkjet ejectors and different lengths of flight time for ink drops result in ink drops not landing at their intended locations. The different lengths of flight times for inkjet ejectors may arise from changing velocities for the ink drops as they are expelled from inkjet ejectors. For example, some inkjet ejector may eject an ink drop after some period of inactivity with a different velocity than an ink drop expelled after a series of ejections. Ink drops fired at different velocities from one or more rows of inkjet ejectors across the face of the printhead are likely to land at different positions in the process direction. This phenomenon may be visually detected as a ragged edge in an image. "Process direction" refers to the direction in which the image receiving member is moving as it passes the printhead and "cross-process direction" refers to the direction across the width of the image receiving member. Efforts to identify image data patterns that reduce ragged edges in images that arise from differences in ink drop velocities are worthwhile.

SUMMARY

A method uses structured dashes to generate process direction correction parameters useful for adjusting image data to be printed. The method includes operating inkjet ejectors in a plurality of printheads to eject ink in a pattern of structured dashes on an image receiving member, the structured dashes corresponding to a predetermined image data pattern, generating image data corresponding to the pattern of structured dashes on the image receiving member, identifying a process direction correction parameter for each ejector in the plurality of printheads with reference to the generated image data, modifying image data to be printed by the plurality of printheads with reference to the process direction correction parameter identified for at least one of the ejectors, and operating the plurality of printheads with reference to the modified image data.

A method identifies image data patterns that are useful for structured dash patterns and replacement patterns. The method includes operating each ejector of each printhead in a plurality of printheads with reference to an image data pattern to eject onto an image receiving member ink drops corresponding to image data in the image data pattern, generating image data corresponding to the ink drops on the image receiving member, measuring a difference between pixels in the generated image data that correspond to the ink drops ejected onto the image receiving member by one ejector operated with reference to the image data pattern and expected positions for the ink drops ejected by the ejector operated with reference to the image data pattern, and selecting the image data pattern for operation of the ejector to generate a test pattern in response to the measured difference being less than a predetermined threshold.

An inkjet imaging system uses structured dashes as replacement patterns in image data to be printed. The system includes a printhead having inkjet ejectors configured to eject ink onto an image receiving member in response to firing signals, a memory in which at least one structured dash is stored for each inkjet ejector in the printhead, and a controller electrically coupled to the printhead and to the memory, the controller being configured to adjust image data used to generate firing signals for an inkjet ejector in a printhead of an inkjet imaging device by substituting the at least one structured dash pattern for an image data pattern within image data to be printed by the inkjet ejector and generating the firing signals for the inkjet ejector with reference to the adjusted image data.

BRIEF DESCRIPTION OF THE DRAWINGS

The foregoing aspects and other features of a printer that identifies and verifies stable image data patterns are explained in the following description, taken in connection with the accompanying drawings, wherein.

DETAILED DESCRIPTION

Figure 8:
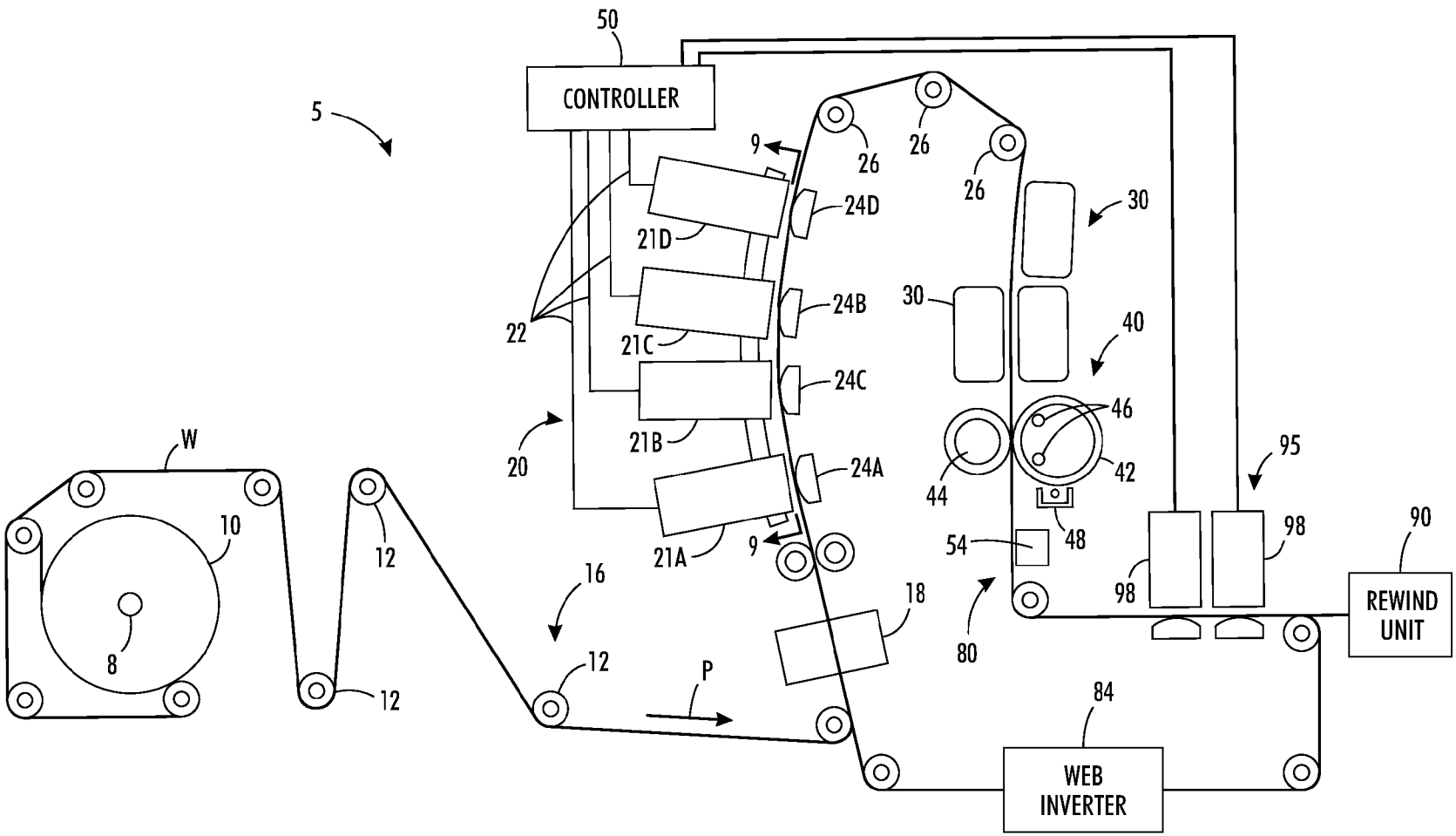
FIG. 8 is a schematic view of an improved inkjet imaging system that identifies first drop correction parameters and last drop correction parameters using structured dashes in test patterns.

Referring to FIG. 8, an inkjet imaging system 5 is shown that has been configured to evaluate transient patterns to select candidates for structured dashes and to identify process direction correction parameters for ejectors in the printheads of the system. For the purposes of this disclosure, the imaging apparatus is in the form of an inkjet printer that employs one or more inkjet printheads and an associated solid ink supply. However, the structured dash methods and correction parameter methods described herein are applicable to any of a variety of other imaging apparatuses that use inkjet ejectors in printheads to form images.

The imaging system includes a print engine to process the image data before generating the control signals for the inkjet ejectors for ejecting colorants. Colorants may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

Direct-to-sheet, continuous-media, phase-change inkjet imaging system 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90. Duplex operations may also be achieved with two printers arranged serially with a web inverter interposed between them. In this arrangement, the first printer forms and fixes an image on one side of a web, the inverter turns the web over, and the second printer forms and fixes an image on the second side of the web. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 95 before being flipped by the inverter 84 and laterally displaced by a distance that enables the web to travel over the other half of the rollers opposite the printing station 20, printed web conditioner 80, and coating station 95 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, that rotate one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of color modules or units 21A, 21B, 21C, and 21D, each color module effectively extends across the width of the media and is able to eject ink directly (i.e., without use of an intermediate or offset member) onto the moving media. The arrangement of printheads in the print zone of system 5 is discussed in more detail with reference to FIG. 9. As is generally familiar, each of the printheads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to calculate the linear velocity and position of the web as the web moves past the printheads. The controller 50 uses these data to generate timing signals for actuating the inkjet ejectors in the printheads to enable the printheads to eject four colors of ink with appropriate timing and accuracy for registration of the differently color patterns to form color images on the media. The inkjet ejectors actuated by the firing signals corresponds to image data processed by the controller 50. The image data may be transmitted to the printer, generated by a scanner (not shown) that is a component of the printer, or otherwise generated and delivered to the printer. In various possible embodiments, a color module for each primary color may include one or more printheads; multiple printheads in an module may be formed into a single row or multiple row array; printheads of a multiple row array may be staggered; a printhead may print more than one color; or the printheads or portions thereof can be mounted movably in a direction transverse to the process direction P, also known as the cross-process direction, such as for spot-color applications and the like.

Each of the color modules 21A-21D includes at least one electrical motor configured to adjust the printheads in each of the color modules in the cross-process direction across the media web. In a typical embodiment, each motor is an electromechanical device such as a stepper motor or the like. As used in this document, electrical motor refers to any device configured to receive an electrical signal and produce mechanical movement. Such devices include, but are not limited to, solenoids, stepper motors, linear motors, and the like. One embodiment illustrating a configuration of print bars, printheads, and actuators is discussed below with reference to FIG. 7. In a practical embodiment, a print bar actuator is connected to a print bar containing two or more printheads. The print bar actuator is configured to reposition the print bar by sliding the print bar in the cross-process direction across the media web. Printhead actuators may also be connected to individual printheads within each of color modules 21A-21D. These printhead actuators are configured to reposition an individual printhead by sliding the printhead in the cross-process direction across the media web.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the printing station 20. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 8, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the electrical motor calibration function, described below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively connected to the print bar and printhead motors of color modules 21A-21D in order to adjust the positions of the printhead bars and printheads in the cross-process direction across the media web. Controller 50 is further configured to determine sensitivity and backlash calibration parameters that are measured for each of the printhead and print bar motors, and to store these parameters in the memory. In response to the controller 50 detecting misalignment that requires movement of a print bar or printhead, controller 50 uses the calibration parameter corresponding to the required direction of movement for the appropriate motor to determine a number of steps that the controller commands the motor to rotate to achieve movement of the print bar or printhead in the required direction.

The imaging system 5 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The optical imaging system may include an array of optical detectors mounted to a bar or other longitudinal structure that extends across the width of an imaging area on the image receiving member. In one embodiment in which the imaging area is approximately twenty inches wide in the cross process direction and the printheads print at a resolution of 600 dpi in the cross process direction, over 12,000 optical detectors are arrayed in a single row along the bar to generate a single scanline across the imaging member. The optical detectors are configured in association in one or more light sources that direct light towards the surface of the image receiving member. The optical detectors receive the light generated by the light sources after the light is reflected from the image receiving member. The magnitude of the electrical signal generated by an optical detector in response to light being reflected by the bare surface of the image receiving member is larger than the magnitude of a signal generated in response to light reflected from a drop of ink on the image receiving member. This difference in the magnitude of the generated signal may be used to identify the positions of ink drops on an image receiving member, such as a paper sheet, media web, or print drum. The reader should note, however, that lighter colored inks, such as yellow, cause optical detectors to generate lower contrast signals with respect to the signals received from unlinked portions than darker colored inks, such as black. Thus, the contrast may be used to differentiate between dashes of different colors. The magnitudes of the electrical signals generated by the optical detectors may be converted to digital values by an appropriate analog/digital converter. These digital values are denoted as image data in this document and these data are analyzed to identify positional information about the dashes on the image receiving member as described below.

Figure 7:
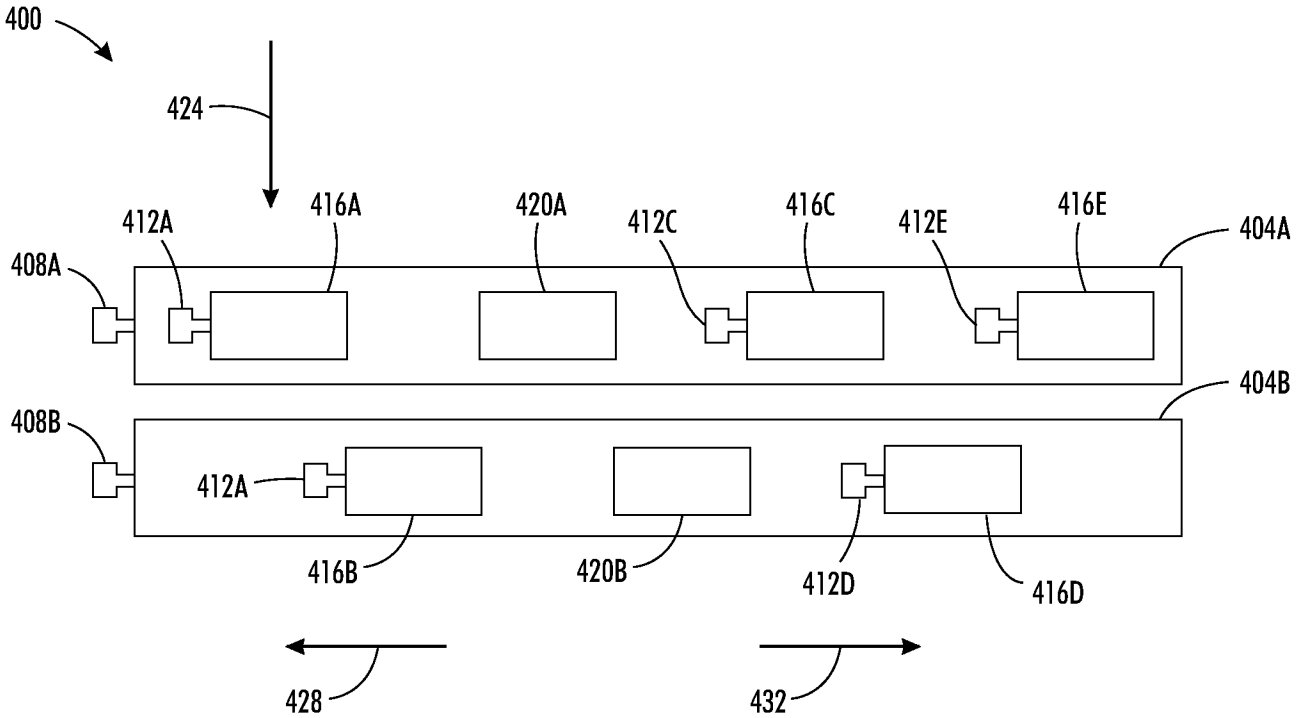
FIG. 7 is a schematic view of a print bar unit that may be used to configure an arrangement of printheads in a print zone of the imaging system of FIG. 9.
Figure 9:
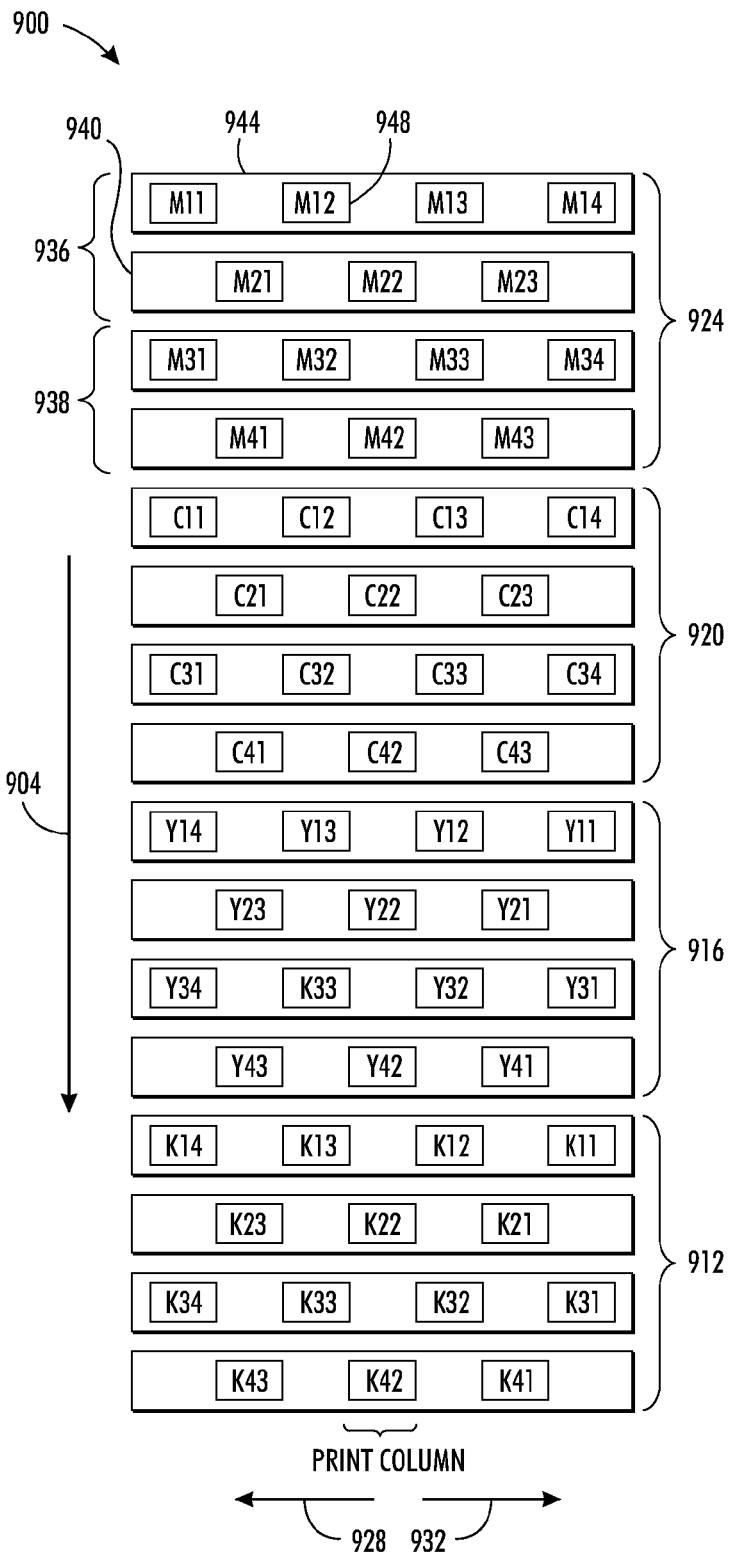
FIG. 9 PRIOR ART
FIG. 9 is a schematic view of a prior art printhead configuration viewed along lines 9-9 in FIG. 8.

A schematic view of a prior art print zone 900 that may be used in the system 5 is depicted in FIG. 9. The print bars and printheads of this print zone may be moved for alignment purposes using the processes described below when the print bars and printheads are configured with actuators for movement of the print bars and printheads as shown in FIG. 7. The print zone 900 includes four color modules or units 912, 916, 920, and 924 arranged along a process direction 904. Each color unit ejects ink of a color that is different than the other color units. In one embodiment, color unit 912 ejects black ink, color unit 916 ejects yellow ink, color unit 920 ejects cyan ink, and color unit 924 ejects magenta ink. Process direction 904 is the direction that an image receiving member moves as the member travels under the color units from color unit 924 to color unit 912. Each color unit includes two print arrays, which include two print bars each that carry multiple printheads. For example, the print bar array 936 of magenta color unit 924 includes two print bars 940 and 944. Each print bar carries a plurality of printheads, as exemplified by printhead 948. Print bar 940 has three printheads, while print bar 944 has four printheads, but alternative print bars may employ a greater or lesser number of printheads. The printheads on the print bars within a print bar array, such as the printheads on the print bars 940 and 944, are staggered to provide printing across the image receiving member in the cross process direction at a first resolution. The printheads on the print bars of the print bar array 936 within color unit 924 are interlaced with reference to the printheads in the print bar array 938 to enable printing in the colored ink across the image receiving member in the cross process direction at a second resolution. The print bars and print bar arrays of each color unit are arranged in this manner. One print bar array in each color unit is aligned with one of the print bar arrays in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

FIG. 7 depicts a configuration for a pair of print bars that may be used in a color module of the system 5. The print bars 404A and 404B are operatively connected to the print bar motors 408A and 408B, respectively, and a plurality of printheads 416A-E and 420A, 420B are mounted to the print bars. Printheads 416A-E are operatively connected to electrical motors 412A-E, respectively, while printheads 420A and 420B are not connected to electrical motors, but are fixedly mounted to the print bars 404A and 404B, respectively. Each print bar motor moves the print bar operatively connected to the motor in either of the cross-process directions 428 or 432. Printheads 416A-416E and 420A-420B are arranged in a staggered array to allow inkjet ejectors in the printheads to print a continuous line in the cross-process direction across a media web. Movement of a print bar causes all of the printheads mounted on the print bar to move an equal distance. Each of printhead motors 412A-412E moves an individual printhead in either of the cross-process directions 428 or 432. Motors 408A-408B and 412A-412D are electromechanical stepper motors capable of rotating a shaft, for example shaft 414, in a series of one or more discrete steps. Each step rotates the shaft a predetermined angular distance and the motors may rotate in either a clockwise or counter-clockwise direction. The rotating shafts turn drive screws that translate print bars 404A-404B and printheads 416A-416E along the cross-process directions 428 and 432.

While the print bar units of FIG. 7 are depicted with a plurality of printheads mounted to each print bar, one or more of the print bars may have a single printhead mounted to the bar. Such a printhead would be long enough in the cross-process direction to enable ink to be ejected onto the media across the full width of the document printing area of the media. In such a print bar unit, an actuator may be operatively connected to the print bar or to the printhead. A process similar to the one discussed below may then be used to position such a wide printhead with respect to multiple printheads mounted to a single print bar or to other equally wide printheads mounted to other print bars. The actuators in this embodiment enable the inkjet ejectors of one printhead to be interlaced or aligned with the inkjet ejectors of another printhead in the process direction.

Figure 1:
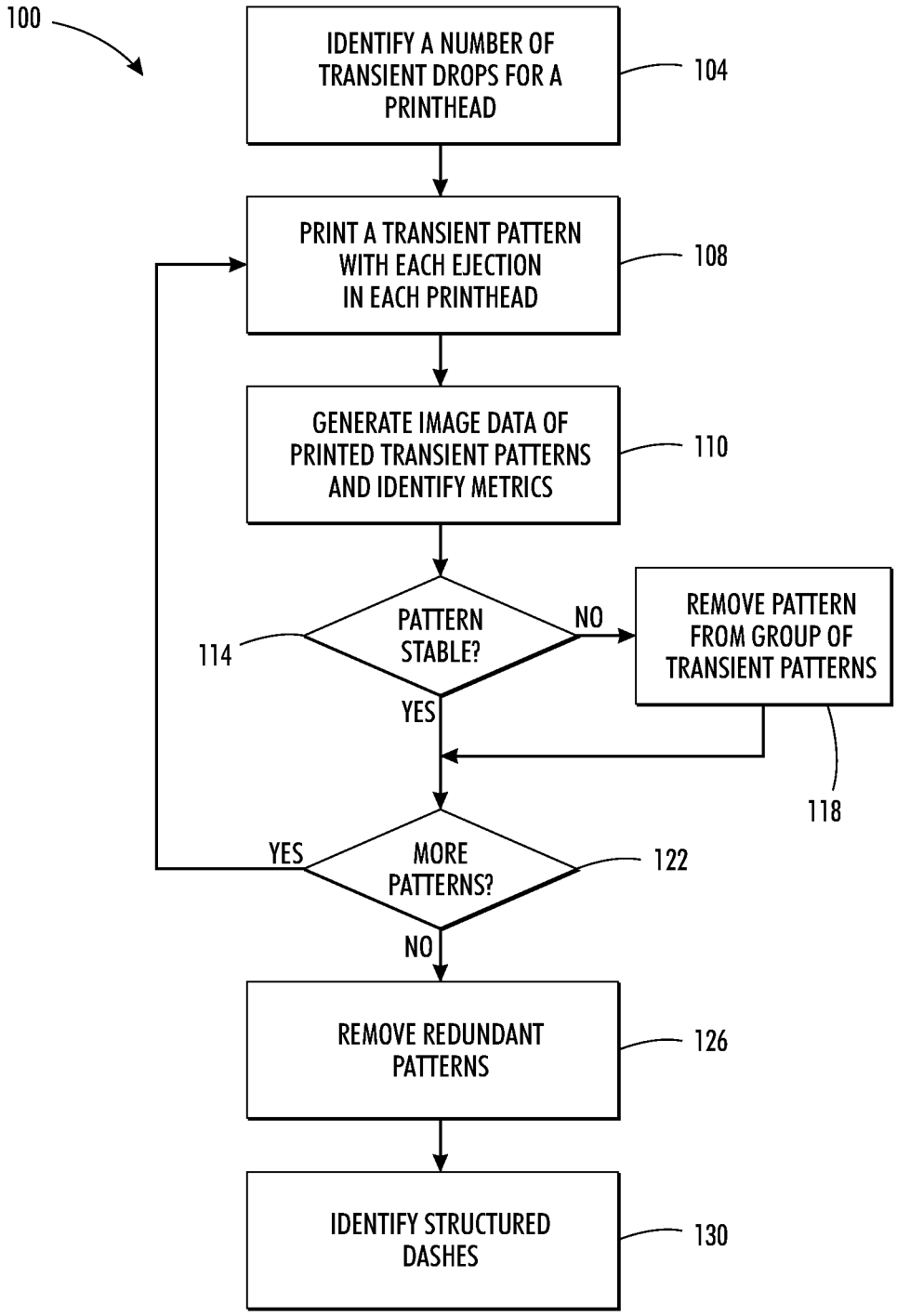
FIG. 1 is a flow diagram of a process for selecting transient patterns as structured dashes.

Referring to FIG. 1, a block diagram of a process 100 for identifying transient patterns that are sufficiently stable for use as structured dashes is depicted. As used in this document, a "structured dash" refers to a sequence of ink drops on an image receiving member other than a predetermined number of sequential ink drops ejected at the printing resolution in the process direction. The sequence of ink drops corresponds to an image data pattern. A structured dash is a pattern of ink drops that is reliably repeatable and useful for image data analysis purposes. Useful patterns are patterns that can be repeatedly formed by an inkjet ejector with a consistent appearance and spacing that corresponds closely to the image data pattern used to generate the structured dash. In previously known systems, a dash was a constant sequence of inkjet ejector operations for a predetermined number of ejections that were intended to produce a line of equally spaced ink drops on the image receiving member. A relatively solid line of ink drops, however, is not frequently printed by an inkjet ejector in actual printing operations. Instead, solid areas are frequently formed with dithering. For example, in some printers, a solid area may be printed with eighty percent of the pixels represented in the image data. That is, solid areas in image data may be used to eject ink drops for some, but not all, of image data values. Consequently, structured dashes that operate an inkjet ejector non-continuously more closely represent operation of an ejector during printing.

Inkjet ejectors exhibit a transient behavior that sometimes produces irregularities in the position and spacing of ink drops. For example, an inkjet ejector that has not been used to eject ink for a period of time corresponding to some number of ink drop ejections may eject ink at a different velocity than an inkjet ejector that has been ejecting ink drops for some period of time. The transit time across the gap separating ejector and the image substrate changes, and the drop lands on the media either sooner or later than intended. As a result, the length of the dash varies depending on the ejector firing history for an ejector. Therefore, not all possible dithering patterns can be reliably produced by an ejector and, consequently, not all dithering patterns are capable of being a structured dash. As noted above, structured dashes are ink drop patterns formed on an image receiving member that are more representative of halftoned or dithered images. Consequently, they can be used to produce a reliable line segment or drop history from an ejector and enable accurate measurement of process direction correction parameters that are used for image data adjustments. Identifying structured dashes for use with an ejector in the printing of test patterns is useful.

In order to adjust image data in accordance with a drop history for an inkjet ejector, a drop history for each inkjet ejector is obtained. One method of obtaining an appropriate drop history is now described although other methods may be used to obtain a process direction correction parameter for an ejector. In some printers, a process direction correction parameter is identified for each ejector and applied to image data to shift the data before printing. In other printers, a process direction correction parameter may be identified for a first ink drop and/or a last ink drop ejected by an inkjet ejector. As used herein "first ink drop" refers to an ink drop ejected by an inkjet ejector after some period of inactivity for the inkjet ejector. The inactive period may only be for a few firing cycles, but sufficiently long enough to cause the inkjet ejector to expel the ink drop at a velocity different than ink drops ejected on the next firing cycle after one in which an ink drop has been ejected. "Last ink drop" refers to the last ink drop ejected by an inkjet ejector and the position of the ink drop relative to other ink drops ejected from an inkjet ejector after a series of at least two consecutive ink drop ejections.

Figure 2A:
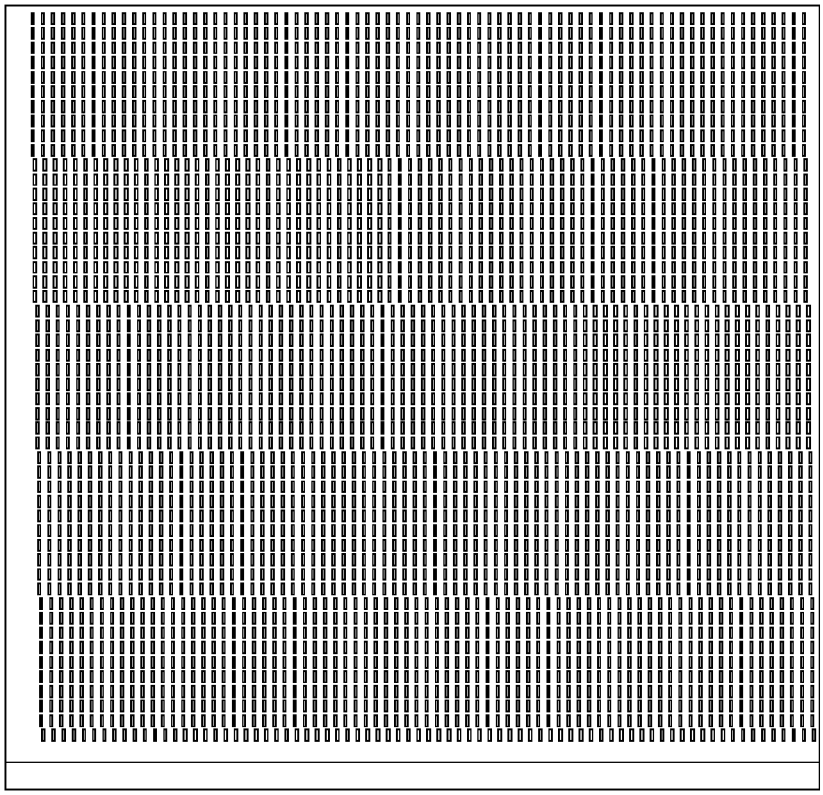
FIG. 2A is a depiction of a test pattern that may be used to identify an ink drop history for inkjet ejector in the printheads of the system shown in FIG. 9
Figure 2B:
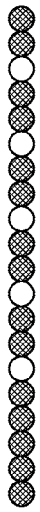
FIG. 2B is an enlarged view of a structured dash that may be printed in the test pattern in FIG. 2A.

A printhead contains a plurality of inkjet ejectors that are equally spaced in the cross process direction. The inkjet ejectors may be staggered in the process direction to provide enough room for the ink reservoirs, electronics, and piezoelectrics arranged within a printhead. The inkjet ejectors can be indexed from 1 to N, where N is the number of inkjet ejectors on the printhead. One test pattern that may be used to obtain a drop history for each inkjet ejector in a printhead is shown in FIG. 2A. The first portion of the pattern is formed by generating the firing signals for inkjet ejector 1 and each fifth inkjet ejector thereafter. Each inkjet ejector producing a dash in a row of the pattern in FIG. 2A is operated to generate ten structured dashes. FIG. 2B depicts an example of image data that may be used to operate an inkjet ejector to form a structured dash. Each filled-in circle in FIG. 2B represents image data that results in a firing signal being generated that causes an inkjet ejector to eject an ink drop towards an image receiving member. Each blank circle represents an inkjet firing cycle in which no ink drop is ejected. Thus, every fifth inkjet ejector in a row of inkjet ejectors ejects a series of ink drops corresponding to the image data used to generate firing signals to form a structured dash that extends in the process direction P. To produce the pattern shown in FIG. 2A, each inkjet ejector is operated to generate ten structured dashes having a predetermined structure, such as the one shown in FIG. 2B, with a predetermined spacing between dashes. The structured dashes help improve the accuracy of the image data processing to identify a drop history for identifying drop correction parameters. Following the generation of a group of structured dashes by the first line of inkjet ejectors, the second inkjet ejector and every fifth subsequent inkjet ejector are operated in a similar manner to form another group of structured dashes. This operation of the inkjet ejectors continues until all of the inkjet ejectors in a printhead have been operated by a controller generating firing signals to form a plurality of groups of process direction lines on the image receiving member that ensure each inkjet ejector has printed a set of process direction lines in one of the groups of process direction lines. This process continues until rows 41 to 50 in the test pattern where the fifth inkjet ejector and every fifth subsequent inkjet ejector is fired. This process may be repeated for different patterns to obtain position information for different inkjet ejector drop histories.

The inkjet ejectors are operated as described above to produce the staggered test pattern so information about the location of the first and last drops of a structured dash may be obtained without interference from structured dashes formed by neighboring inkjet ejectors. Additionally, the length of a structured dash is chosen with reference to a combination of the printing speed and the imaging rate of the optical sensor. In the depicted example, the structured dashes are produced with a sequence of twenty consecutive possible and fifteen actual ink drop ejections, the test pattern is printed at 490 spi (spots per inch) in the process direction and is imaged at 270 spi in the process direction. An ejector cycle corresponds to a scanline in the image data. An ejector may eject or not eject an ink drop during an ejector cycle.

As noted above, an optical sensor may be operated to generate image data corresponding to the ink drop positions on the image receiving member. The optical sensor includes a light source and a light detector. The light source is directed towards the image receiving member and the light detector is located at a position to receive the reflected light. In the locations where the image receiving member is not covered by ink, most of the light is reflected by the image receiving member into a sensor in the light detector. In response, the sensor generates an electrical signal having a magnitude corresponding to the intensity of the reflected light. Thus, the signals generated by sensors in the light detector that receive light reflected by ink drops are lower than the signals generated by sensors that receive light reflected by the bare image receiving member. These electrical signals comprise image data of the test pattern. These image data are provided to a controller configured to process the image data and generate the first ink drop correction parameter and the last ink drop correction parameter for each inkjet in the printhead. The optical sensor may be positioned in the imaging system, as shown in FIG. 8, or it may be within an offline scanner through which the printed media is scanned after the media is removed from the imaging system.

Figure 3:
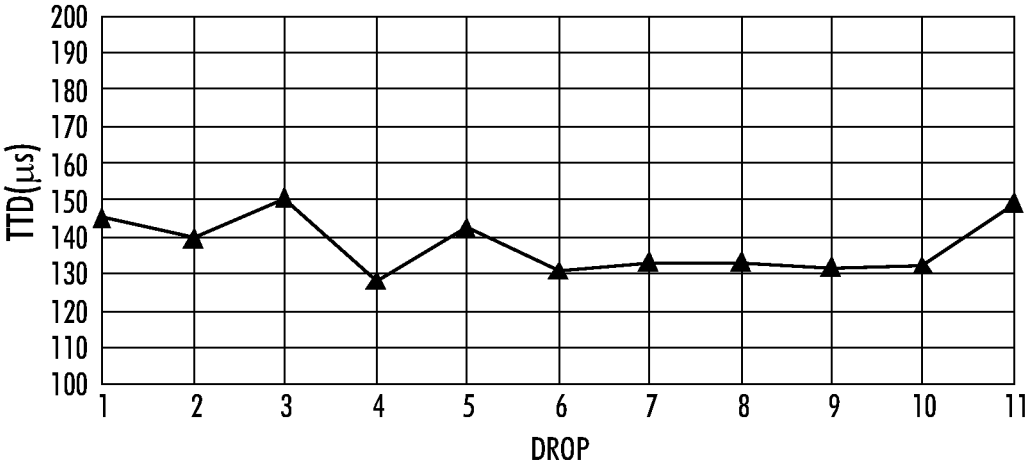
FIG. 3 is a graph of ink drop velocity versus ink drop number for an inkjet ejector in a printhead.

To identify transient or dither patterns that may be used to produce structured dashes, the process of FIG. 1 may be implemented in an imaging system. The process 100 begins by identifying the number of transient drops for a printhead (block 104). The number of transient drops is typically the same for all of the inkjet ejectors in a printhead. The identification of transient drops is typically done by operating ejectors in a printhead positioned in a test fixture one at a time. The velocity of the ejected ink drops may be directly measured by determining the time it takes the drop to move a given distance away from the ejector. With the test fixture results, one can observe that the drop velocity depends upon the number of drops that preceded a drop ejected from an ejector after a period of rest. The velocity can be plotted in a graph, such as the one shown in FIG. 3. In the graph, the X-axis identifies a drop number and the Y-axis identifies a length of time that an ink drop travels from the ejector to the image substrate. This time length is related to ink drop velocity. With reference to FIG. 3, one can observe that the velocity of an ejected ink drop does not stabilize until the sixth consecutive ink drop is ejected. Thus, the inkjet ejector's behavior is transient over the first five drops of ink ejection after a period of rest. A transient period of behavior for each drop in a printhead may be obtained and averaged over all of the ejectors in a printhead to arrive at an average number of drops in which ejectors in the printhead exhibit transient behavior. Alternatively, a predetermined number of drops may be assigned to an inkjet ejector for evaluation. As used in this document, "mean average" and "average" refer to any mathematical technique for calculating, identifying, or substantially approximating a statistical average.

The average number of ink drops for a transient period for a printhead may be used to identify possible transient patterns. For example, a printhead that on average exhibits transient behavior during the first five drops of ink ejection has $2^5$ transient pattern possibilities. That is, the inkjet ejector may be operated to eject ink following a period of rest in 32 different ways. As used in this document, "transient pattern" refers to image data patterns that may be used to operate an inkjet ejector during a period of time before stabilization of ink drop velocity is expected from the ejector. While all of the transient patterns are possible candidates for being structured dashes, some may be eliminated by analysis without printing. For example, patterns that print only one ink drop are not sufficiently different that each pattern needs to be tested. In general, $2^{n-1}$ transient patterns require testing for a printhead, where n is the average number of transient drops for a printhead. Alternatively, dither patterns for the predetermined number of drops assigned to an inkjet ejector may be evaluated to identify structured dashes.

With continued reference to FIG. 1, once a group of transient or dither patterns have been selected from the possible transient or dither patterns, each ejector in each printhead is operated with image data corresponding to one of the transient patterns in the group of transient patterns (block 108). Image data of the ejected ink pattern is generated with an optical imaging system and analyzed by a processor configured to generate metrics corresponding to the ejected ink drop pattern (block 110). In this processing, prints may be made of each transient pattern. Magnified images of a subset of the nozzles are captured from the generated prints and both qualitative and quantitative criteria are used to assess the stability of the transient pattern. One criterion is the tendency of the drops to coalesce, although there may be other criteria. If the coalescence of the drops is repeatable from nozzle to nozzle, then the transient pattern is deemed stable, otherwise it is deemed unstable. If an unstable pattern is detected (block 114), the pattern is removed from the group of transient patterns being evaluated for structured dashes (block 118).

The process continues for each transient pattern candidate (block 122). Once the stable transient patterns have been identified, the image data for similar patterns may be overlaid on one another to eliminate redundant patterns (block 126). For example, a single ink drop printed pattern and a two ink drop printed pattern may consistently print at similar positions, although the two drop pattern produces a larger conglomerate drop than the single drop pattern. Consequently, one of the patterns can be eliminated. Once the redundant patterns are eliminated, structured dashes for an inkjet ejector have been identified (block 130). The structured dashes may be used to generate a drop history for an inkjet ejector and the drop history for an inkjet ejector may be used to identify a process direction correction parameter for the inkjet ejector.

Additionally, the structured dashes may be substituted for image data patterns detected in image data that are not reliably printed by an inkjet ejector. For example, known image processing methods search image data to detect image data patterns that result in ink drops being ejected at different velocities. Consequently, the drops do not arrive at the image substrate at the intended times and the actual pattern printed is different than the intended pattern. When such a pattern is detected in image data to be printed, a more reliably printed image pattern may be substituted for the less reliably produced image pattern. The structured dashes identified by the process in FIG. 1 are image data patterns more reliably ejected by an ejector and thus, are good candidates for substitution patterns.

Figure 4:
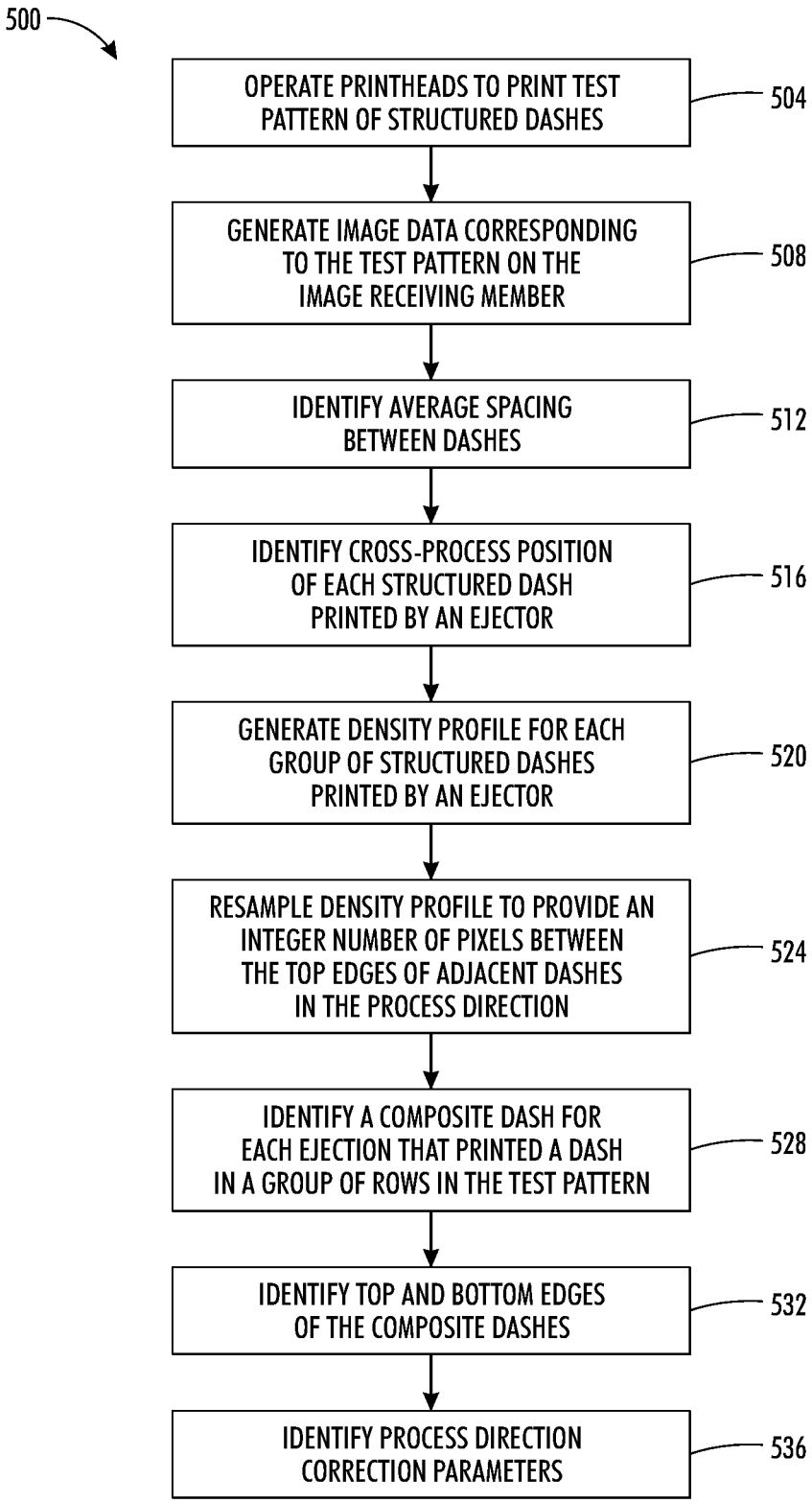
FIG. 4 is a flow diagram of a process for using a test pattern having structured dashes to identify a first ink drop correction parameter and a last ink drop correction parameter for each inkjet ejector in a printhead.

A process for generating a drop history for each inkjet ejector in a printhead and identifying the process direction correction parameters for each ejector is shown in FIG. 4. The process 500 begins with a test pattern of structured dashes being printed (block 504). The test pattern may be a pattern like the one shown in FIG. 2A and the structured dash may be like the one shown in FIG. 2B, although other patterns and structured dashes may be used. Image data of the test pattern on the image receiving member is then generated (block 508). The image data may be generated with the optical imaging system described above or some other imaging system. The average spacing between dashes is identified (block 512). As used in this document, the words "calculate" and "identify" include the operation of a circuit comprised of hardware, software, or a combination of hardware and software that reaches a result based on one or more measurements of physical relationships with accuracy or precision suitable for a practical application. To identify the average spacing, scanlines of image data that include the top of a structured dash, the bottom of a structured dash, or both are selected and used for the distance measurements between dashes and these measured distances are used to identify the average spacing. The identification of the spacing is performed because spacing may vary slightly because the speed of the image receiving member may vary slightly. This variation may be more noticeable in web printing systems.

Figure 5A:
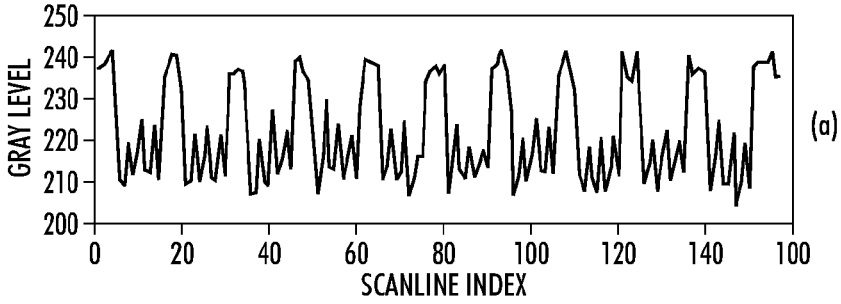
FIG. 5A is a density profile for a set of structured dashes in the test pattern of FIG. 2A
Figure 5B:
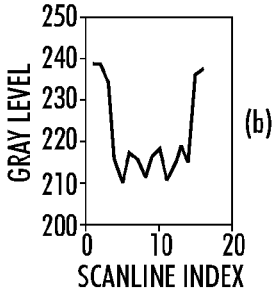
FIG. 5B is a density profile for a composite structured dash produced from the density profile in FIG. 5A.
Figure 6:
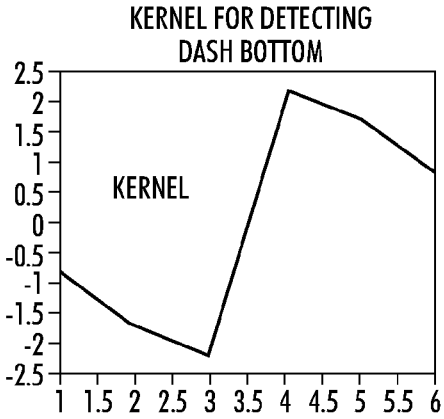
FIG. 6 is a bottom edge kernel function used to detect the bottom edge of the composite structured dash shown in FIG. 5B.

The process 500 also identifies a cross-process position for each dash printed by an inkjet ejector (block 516). For a line of structured dashes in the process direction printed by a single ejector, a profile density is generated (block 520). An example of a density profile is shown in FIG. 5A. The areas of low response 604, 608, 612, 616, and 620 correspond to the noise within structured dashes for one of the inkjet ejectors that is caused by the varying drop spacing. As shown in the figure, the structured dashes appear noisy because they are likely to have non-printed areas in them. In order to identify a first ink drop position and a last ink drop position, the density profile is re-sampled to ensure an integer number of pixels occur between the expected top edge of each dash (block 524). As used in this document, "pixel" refers to a response of an optical detector to the image receiving member and test pattern during a sampling period. After the profile is re-sampled, all of the segments of the profile corresponding to the same distance from a fixed reference point from each dash in the sequence of dashes are averaged to identify a composite structured dash for the density profile (block 528). An example of a composite structured dash 604 is shown in FIG. 5B. This composite structured dash 604 is the average of the profiles for the ten structured dashes in the profile of FIG. 5A. The averaging of the structured dash profiles has reduced the noise caused by structure in the image receiving member, variations in the coalescence in ink drops forming structured dashes, and phase differences between the optical detector resolution and the resolution of the printing. The top and bottom edges of the composite structured dash are now more robustly detected by convolving the composite structured dash with a top edge kernel function and a bottom edge kernel function by the controller configured to process the image data (block 532). As used in this document, "convolution" refers to the summation of the product of two functions and "kernel" refers to a function that is defined so the convolution of the density profile and the kernel function is a minimum at either the top edge of a structured dash in a column of structured dashes in the process direction or at the bottom edge of a structured dash in a column of structured dashes in the process direction. In one embodiment, a bottom edge kernel function, such as the one shown in FIG. 6, is used to detect a bottom edge of a structured dash. The bottom edge kernel function is defined so the convolution of the density profile and the bottom edge kernel function is a minimum at the bottom of a composite structured dash. The convolution result enables the position for the last ink drop that formed a dash to be identified. The corresponding top edge kernel function would be the opposite sign of the bottom edge kernel function and the convolved signal is a minimum at the top of the composite structured dash. Thus, the controller convolves each composite structured dash for each set of structured dashes printed by each inkjet ejector with the top edge kernel function and the bottom edge kernel function to identify the positions for the first ink drop and the last ink drop in each set of structured dashes. From the positional information about the structured dash, a single process direction correction parameter, a first ink drop process direction correction parameter, and/or a last ink drop correction parameter may be identified for an inkjet ejector (block 536).

To generate a last ink drop correction parameter for each inkjet ejector, the controller configured to process the image data for the test pattern identifies a mean average for the first ink drop position and the last ink drop position for each composite structured dash for each inkjet ejector that formed a set of structured dashes in the process direction that are aligned in the cross-process direction to form rows with one another. For example, a composite structured dash is identified for each ejector that formed the first ten rows in the pattern of FIG. 2A. All of the top edge positions for the composite structured dashes and all of the bottom edge positions for the composite structured dashes are identified and all of the top edge positions are averaged to identify an average top edge position and all of the bottom edge positions are averaged to identify an average bottom edge position for those ejectors. A last ink drop position parameter is then computed by taking the difference between the bottom edge position for each composite structured dash and the average bottom edge position. A last ink drop correction parameter is then calculated by taking the negative of the last ink drop position parameter and rounding to an integral pixel unit. A first ink drop position parameter is then computed by taking the difference between the top edge position for each composite structured dash and the average top edge position. A first ink drop correction parameter is then calculated by taking the negative of the first ink drop position parameter and rounding to an integral pixel unit.

Once the first ink drop correction parameter and the last ink drop correction parameter have been generated and stored in a memory for each inkjet ejector in a printhead, the controller may configured with appropriate programming and circuitry to adjust image data. The adjustment of image data using first ink drop correction parameters and last ink drop correction parameters is disclosed in co-pending U.S. patent application Ser. No. 12/699,582, which is entitled "Ink Drop Position Correction In The Process Direction Based On Ink Drop Position History" and which was filed on Feb. 3, 2010. This application is commonly assigned to the owner of this document and is hereby expressly incorporated in its entirety by reference into this document.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet imaging system that compensates for changes in drop velocity in inkjet ejectors, the system comprising:

a printhead having inkjet ejectors configured to eject ink onto an image receiving member in response to firing signals;

a memory in which at least one structured dash is stored for each inkjet ejector in the printhead; and a controller electrically coupled to the printhead and to the memory, the controller being configured to adjust image data used to generate firing signals for an inkjet ejector in a printhead of an inkjet imaging device by substituting the at least one structured dash pattern stored in the memory for the inkjet ejector for an image data pattern within image data to be printed by the inkjet ejector, the at least one structured dash pattern being configured to operate the inkjet ejector only non-continuously over a predetermined number of pixels that is greater than one and the image data pattern in the image data being configured to operate the inkjet ejector only continuously over the predetermined number of pixels that is greater than one, and generating the firing signals for the inkjet ejector with reference to the image data adjusted with the at least one structured dash pattern.

2. The inkjet imaging system of claim 1, the controller being further configured to operate inkjet ejectors in a plurality of printheads to eject ink in a pattern of structured dashes on an image receiving member, to identify a process direction correction parameter for each ejector in the plurality of printheads with reference to image data corresponding to the pattern of structured dashes on the image receiving member, to modify image data to be printed by at least one of the inkjet ejectors in the plurality of printheads with reference to the process direction correction parameter identified for the at least one inkjet ejector, and to operate the at least one inkjet ejector with reference to the modified image data.

3. The inkjet imaging system of claim 2, the controller being further configured to identify a first drop correction parameter and a last drop correction parameter for each inkjet ejector in the plurality of printheads and to adjust the image data configured to operate the inkjet ejector only continuously over the predetermined number of pixels that is greater than one with reference to the first drop correction parameter and a last drop correction parameter identified for the inkjet ejector.

* * * * *